US009932696B2

(12) United States Patent
Le Costaouec

(10) Patent No.: US 9,932,696 B2
(45) Date of Patent: Apr. 3, 2018

(54) SYSTEM AND METHOD FOR TRANSPORT OF FIBERS TO/FROM A CIRCULAR NEEDLE-PUNCHING LOOM

(71) Applicant: Goodrich Corporation, Charlotte, NC (US)

(72) Inventor: Jean-Francois Le Costaouec, Pueblo West, CO (US)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 15/632,010

(22) Filed: Jun. 23, 2017

(65) Prior Publication Data

US 2017/0292211 A1 Oct. 12, 2017

Related U.S. Application Data

(62) Division of application No. 14/286,077, filed on May 23, 2014, now Pat. No. 9,719,199.

(51) Int. Cl.
*D04H 3/105* (2012.01)
*D04H 18/02* (2012.01)
(Continued)

(52) U.S. Cl.
CPC ..... *D04H 3/105* (2013.01); *D04H 1/4242* (2013.01); *D04H 1/46* (2013.01); *D04H 18/02* (2013.01)

(58) Field of Classification Search
CPC ..... D04H 18/02; D04H 1/4242; D04H 3/105; D04H 1/46; D04H 1/48; D04H 1/498; D04H 3/002; D04H 3/102; D04H 5/02; D04H 5/08; D04H 1/4374; D04H 18/00; D04H 13/001; D04H 13/005; D04H 1/70; D04H 3/02; Y10T 428/163; Y10T 428/164; Y10T 428/166; Y10T 428/168
(Continued)

(56) References Cited

U.S. PATENT DOCUMENTS 3,867,491 A * 2/1975 Marin ..... C04B 35/83 264/29.1
4,490,201 A * 12/1984 Leeds ..... C04B 35/83 156/155
(Continued)

FOREIGN PATENT DOCUMENTS

EP 2264330 12/2010
EP 2457885 5/2012

OTHER PUBLICATIONS

Communication pursuant to Article 94(3) EPC dated Apr. 11, 2017 in European Application No. 15168356.2.
(Continued)

*Primary Examiner* — Amy Vanatta
(74) *Attorney, Agent, or Firm* — Snell & Wilmer, L.L.P.

(57) ABSTRACT

A circular needle loom comprises a bed plate for receiving a transport layer. Engagement members may be disposed proximate to the bed plate, such that the engagement members interface with a positional structure of the transport layer that is used to position and rotate the transport layer around the bed plate. The engagement members may be configured to rotate the transport layer around the bed plate until a predetermined number of fibers and/or layers are deposited on the transport layer and/or bed plate in order to create a needled preform.

4 Claims, 5 Drawing Sheets

(51) Int. Cl.
*D04H 1/4242* (2012.01)
*D04H 1/46* (2012.01)

(58) Field of Classification Search
USPC ..... 28/107, 110, 115
See application file for complete search history.

(56) References Cited

U.S. PATENT DOCUMENTS 4,790,052 A 12/1988 Olry
5,203,059 A 4/1993 Olry et al.
5,388,320 A * 2/1995 Smith ..... B29B 11/16 28/107
5,546,880 A * 8/1996 Ronyak ..... B29C 70/228 112/420
5,609,707 A 3/1997 Bazshushtari
5,662,855 A 9/1997 Liew et al.
5,758,394 A * 6/1998 Linck ..... D04H 18/00 28/107
6,009,605 A 1/2000 Olry et al.
6,105,223 A 8/2000 Brown et al.
6,183,583 B1 2/2001 Duval et al.
6,767,602 B1 7/2004 Duval et al.
8,375,536 B2 2/2013 Delecroix et al.
2003/0232169 A1* 12/2003 Kawai ..... C03C 3/093 428/66.6
2006/0090314 A1* 5/2006 Delecroix ..... D04H 1/498 28/100
2007/0186396 A1* 8/2007 Linck ..... C04B 35/645 28/112
2010/0000070 A1* 1/2010 La Forest ..... C04B 35/83 29/525.06
2010/0293769 A1 11/2010 La Forest
2011/0111123 A1* 5/2011 La Forest ..... C04B 35/83 427/249.2
2011/0275266 A1 11/2011 Le Costaouec
2016/0017526 A1* 1/2016 Miao ..... D04H 1/4374 428/66.6

OTHER PUBLICATIONS

Extended European Search Report dated 2015 in European Application No. 15168356.2.
Pre-Interview Office Action dated Sep. 22, 2016 in U.S. Appl. No. 14/286,077.
First Action Interview Office Action dated Dec. 21, 2016 in U.S. Appl. No. 14/286,077.
Notice of Allowance dated Mar. 29, 2017 in U.S. Appl. No. 14/286,077.
Communication pursuant to Article 94(3) EPC dated Oct. 31, 2017 in European Application No. 15168356.2.

* cited by examiner

SYSTEM AND METHOD FOR TRANSPORT OF FIBERS TO/FROM A CIRCULAR NEEDLE-PUNCHING LOOM

CROSS-REFERENCE TO RELATED APPLICATIONS

This application is a divisional of U.S. Ser. No. 14/286,077, filed on May 23, 2014 and entitled "SYSTEM AND METHOD FOR TRANSPORT OF FIBERS TO/FROM A CIRCULAR NEEDLE-PUNCHING LOOM," which is hereby incorporated by reference in its entirety.

FIELD

This disclosure generally relates to transport, positioning and securing a textile, and more particularly, to systems and methods for transport, positioning and securing carbonized carbon fibers mounted on a transport layer on the stationary or the rotational bed plate of circular needle-punching looms.

BACKGROUND

Carbon/carbon ("C/C") parts are employed in various industries. An exemplary use for C/C parts includes using them as friction disks such as aircraft brake disks, race car brake disks, clutch disks, and the like. C/C brake disks are especially useful in such applications because of the superior high temperature characteristics of C/C material. In particular, the C/C material used in C/C parts is a good conductor of heat and thus is able to dissipate heat away from the braking surfaces that is generated in response to braking. C/C material is also highly resistant to heat damage, and is thus capable of sustaining friction between brake surfaces during severe braking, without a significant reduction in the friction coefficient or mechanical failure.

A circular needle loom may be utilized to form a circular preform, for example, for use in creating net shape carbon brake disks. Various textile technologies exist for fabricating a continuous carbon feed form for a circular needle loom, including yarn placement, stitch bonding, pre-needling, and loom weaving with conical take-up rolls.

Significantly, prior art looms and other apparatuses for manufacturing circular preforms suffer from inefficiencies in the manufacturing process. For example, a brush bed plate for a circular needle loom may be utilized to prepare a net shape brake preform. A rotary brush bed plate may be utilized to meet the transport and needling specifications of a thicker fibrous structure like a brake disk preform. However, maintenance and cleaning of the brush bed plate, and removal of the finished preform from the bed plate create extra steps in the needling process. These extra steps, among other reasons, substantially add to the time required to manufacture the preform, resulting in reduced efficiency, lower output and increased cost. Such brush bed plates are therefore generally not suitable for high production rates.

Furthermore the brush bed plate does not always provide sufficient anchorage of the bottom layers, resulting in some cases of preform transport interruption during fabrication. The characteristics of the brush may change over time, thus resulting in higher maintenance and possibly in higher part to part characteristic variations than a smooth bed plate.

SUMMARY

In order to address the deficiencies outlined above, various embodiments may comprise a substantially annular shaped carbonized carbon fiber layer coupled to a substantially annular shaped scrim layer. The substantially annular shaped carbonized carbon fiber layer may substantially surround a first annular shaped scrim portion. A second annular shaped scrim portion may substantially surround the substantially annular shaped carbonized carbon fiber layer.

According to various embodiments, a method may include coupling a carbonized carbon fiber layer to a scrim layer to form a transport layer. The method may include positioning the transport layer on a circular needle loom. The may include rotating the transport layer on the circular needle loom such that carbon fibers are deposited on the carbonized carbon fiber layer and are delivered to a needling zone. The method may include needling the carbon fibers and the carbonized carbon fiber layer to create a first needled carbon fiber layer. The method may include adding additional carbon fibers on the first needled carbon fiber layer. The method may include needling additional carbon fibers and the first needled carbon fiber layer to create a second needled carbon fiber layer and removing the first needled carbon fiber layer and the second needled carbon fiber layer from the circular needle loom.

BRIEF DESCRIPTION OF THE DRAWINGS

The present disclosure may be better understood with reference to the following drawing figures and description. Non-limiting and non-exhaustive descriptions are described with reference to the following drawing figures. The components in the figures are not necessarily to scale, emphasis instead being placed upon illustrating principles. In the figures, like referenced numerals may refer to like parts throughout the different figures unless otherwise specified. Further, because the disclosed fibers, tows and yarns (and their orientations) in practice are very small and closely packed, the figures herein may show exaggerated and/or idealized fiber width and spacing in order to more clearly illustrate the fiber orientations and shape of the bundles.

DETAILED DESCRIPTION

Figure 1:
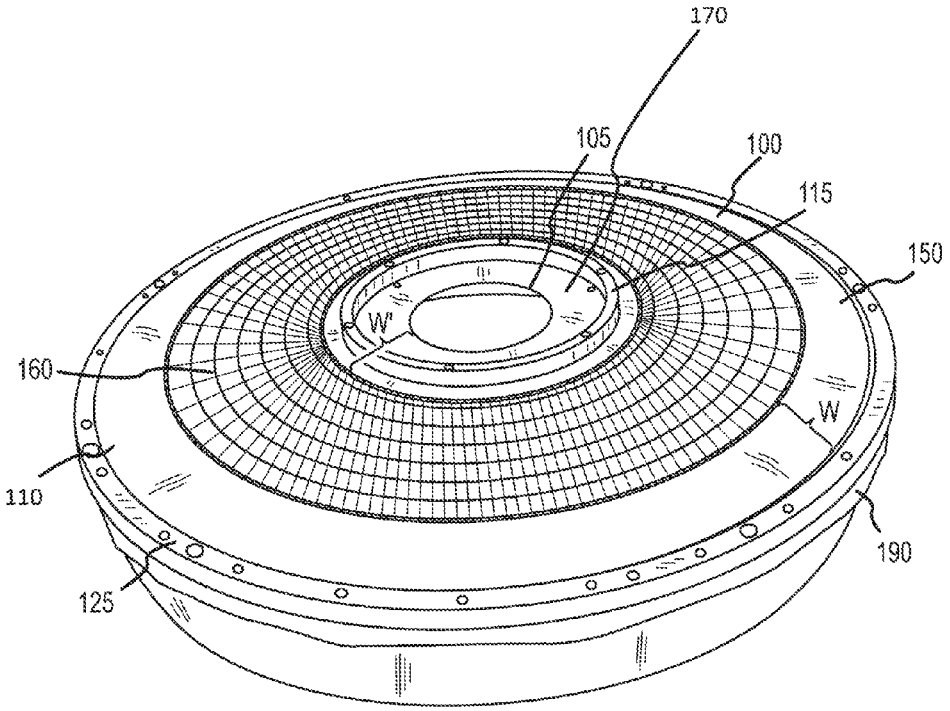
FIG. 1 illustrates a securing mechanism of transport layer to a circular needle loom brush bed plate according to various embodiments related to rotating brush bed plate loom configuration.

The detailed description of various embodiments herein makes reference to the accompanying drawing figures, which show various embodiments and implementations thereof by way of illustration and its best mode, and not of limitation. While these embodiments are described in sufficient detail to enable those skilled in the art to practice the embodiments, it should be understood that other embodiments may be realized and that logical and mechanical changes may be made without departing from the spirit and scope of the disclosure. Furthermore, any reference to singular includes plural embodiments, and any reference to more than one component or step may include a singular embodiment or step.

Also, any reference to attached, fixed, connected or the like may include permanent, removable, temporary, partial, full and/or any other possible attachment option. Additionally, any reference to without contact (or similar phrases) may also include reduced contact or minimal contact. Finally, though the various embodiments discussed herein may be carried out in the context of an aircraft, it should be understood that systems and methods disclosed herein may be incorporated into any system or device using a brake or having a wheel, or into any vehicle such as, for example, an aircraft, a train, a bus, an automobile and the like.

C/C material is generally formed by utilizing continuous oxidized polyacrylonitrile (PAN) fibers, referred to as "OPF" fibers. Such OPF fibers are the precursors of carbonized PAN fibers and are used to fabricate a preformed shape using a needle punching process. OPF fibers are layered in a selected orientation into a preform of a selected geometry. Two or more layers of fibers may be layered onto a support and are then needled together simultaneously or in a series of needling steps. This process interconnects the horizontal fibers with a third direction (also called the z-direction). The fibers extending into the third direction are also called z-fibers. This needling process may involve driving a multitude of barbed needles into the fibrous layers to displace a portion of the horizontal fibers into the z-direction.

As used herein, the terms "tow" and "cable" are used to refer to one or more strands of substantially continuous filaments. Thus, a "tow" or "cable" may refer to a plurality of strands of substantially continuous filaments or a single strand of substantially continuous filament. "Fiber bundle" may refer to a tow of substantially continuous filaments. "Fiber bundle" may also refer to various formats of narrow strips of stretch broken fibers. A "textile" may be referred to as a "fabric" or a "tape." A "loom" may refer to any weaving device, such as a narrow fabric needle loom.

As used herein, the term "ribbon" is used to refer to a closely packed bundle of continuous filaments and discontinuous filaments like stretch broken fibers generally delivered from a spool. A "span" as used herein may be a length of ribbon and/or tow. As used herein, the term "yarn" is used to refer to a strand of substantially continuous fibers or staple fibers or blends of these, thus the term "yarn" encompasses tow and cable. As used herein, the unit "K" represents "thousand." Thus, a 1K tow means a tow comprising about 1,000 strands of substantially continuous filaments. For example, a "heavy tow" may comprise about 48,000 (48K) textile fibers in a single tow, whereas a "medium tow" may comprise about 24,000 (24K) textile fibers within a single tow whereas a "lighter tow" may comprise about 6,000 (6K) textile fibers within a single tow. Fewer or greater amounts of textile fibers may be used per cable in various embodiments. In various embodiments disclosed herein, fabrics in accordance with various embodiments may comprise tows of from about 0.1K to about 100K, and, in various embodiments, heavier tows. As is understood, "warp" fibers are fibers that lie in the "warp" direction in the textile, i.e., along the length of the textile. "Weft" fibers are fibers that lie in the "weft" direction in the textile, i.e., along the width of the textile. Warp fibers may be described as being spaced apart with respect to the weft direction (i.e., spaced apart between the outer diameter (OD) and inner diameter (ID) of the textile). Similarly, the weft tows may be described as being spaced apart with respect to the warp direction.

In various embodiments, any combination of warp and weft tow size may be used. For example, 48 k warp tows may be used with 24 k weft tows. Also for example, other combinations of warp tows to weft tows include: 48K:12K, 24K:24K, and 24K:12K. A ribbon/carbon fiber tow may be wrapped around a round spool for ease of transport and feeding into a weaving apparatus for fabricating a fabric which is used in a subsequent preforming process using needle punching. The ribbon on the spool comprises a generally closed packed rectangular cross sectional shape. A length of ribbon may be delivered from the spool to the weaving apparatus. In response to being manipulated under tension by a weaving apparatus, the generally rectangular shaped cross section of the ribbon changes to a generally oval shaped cross section. This oval shaped cross section is undesirable and a preferred approach is to spread the ribbon in the Y direction to increase the width, W, of the ribbon to increase coverage and reduce fiber volume. The ribbon may be spread mechanically through passage over and under specially shaped bars. In the alternative, the ribbon may be spread via vacuum suction or through ultrasonic vibration. Alternatively, it may be advantageous to provide bulk to the tow through the use of an air jet, thus re-orienting a portion of the fibers and providing greater volume to the tow.

According to various embodiments, a circular needle loom system may include a stationary bed plate configured to receive a transport layer, engagement members disposed proximate the stationary bed plate and a carbon fiber delivery system configured for deploying carbon fibers on the transport layer. The circular needle loom system may include a conical roller configured to guide and keep flat the fiber tows or feed fabric. The feeding textile may take the form of a pre-woven continuous helical fabric, tows directly laid-down at the circular needle loom or a hybrid form of pre-woven fabric and tows laid down at the circular needle loom. The engagement members may be configured to interface with a portion of the transport layer to facilitate rotating the transport layer around the stationary bed plate and/or a rotating brush bed plate. An alternate circular needle loom system may include a rotating bed plate configured in the form of a brush to receive a transport layer. Feed fabric or tows may be introduced on transport layer similarly in the case of a stationary bed plate. Engagement members may comprise pins, spikes, clamps, rails, fingers, combs, chains, belts, and other similar mechanisms, as further described and illustrated herein, that tend to promote motion of a transport layer with respect to a loom. In various embodiments, multiple types of engagement members may be present. For example, in various embodiments, both pins and combs may be used as engagement members.

Furthermore, in some applications, like the manufacturing of C/C friction disks where the dry fabric may be subsequently transformed into a 3D fiber structure, such as through a needle punching/needling process, looser spread tows and/or volumized tows are more conducive to the fabrication of a textile preform with a homogeneous fiber distribution within each horizontal plane of the textile.

During fabrication of annular preforms, such as those used in aircraft brake needled preforms, it is desirable, in addition to fiber orientations, to control the shape and the fiber volume of the carbon fiber tows during the various textile steps preceding the needle-punching step. Looser/bulkier spread tows are more conducive to the fabrication of a textile brake preform exhibiting a homogeneous fiber distribution within each horizontal plane of the textile. Furthermore, the use of flat spread tows allows the fabrication of low areal weight fabrics with full fiber coverage using larger tows such as 12 to 50K tows.

Figure 2:
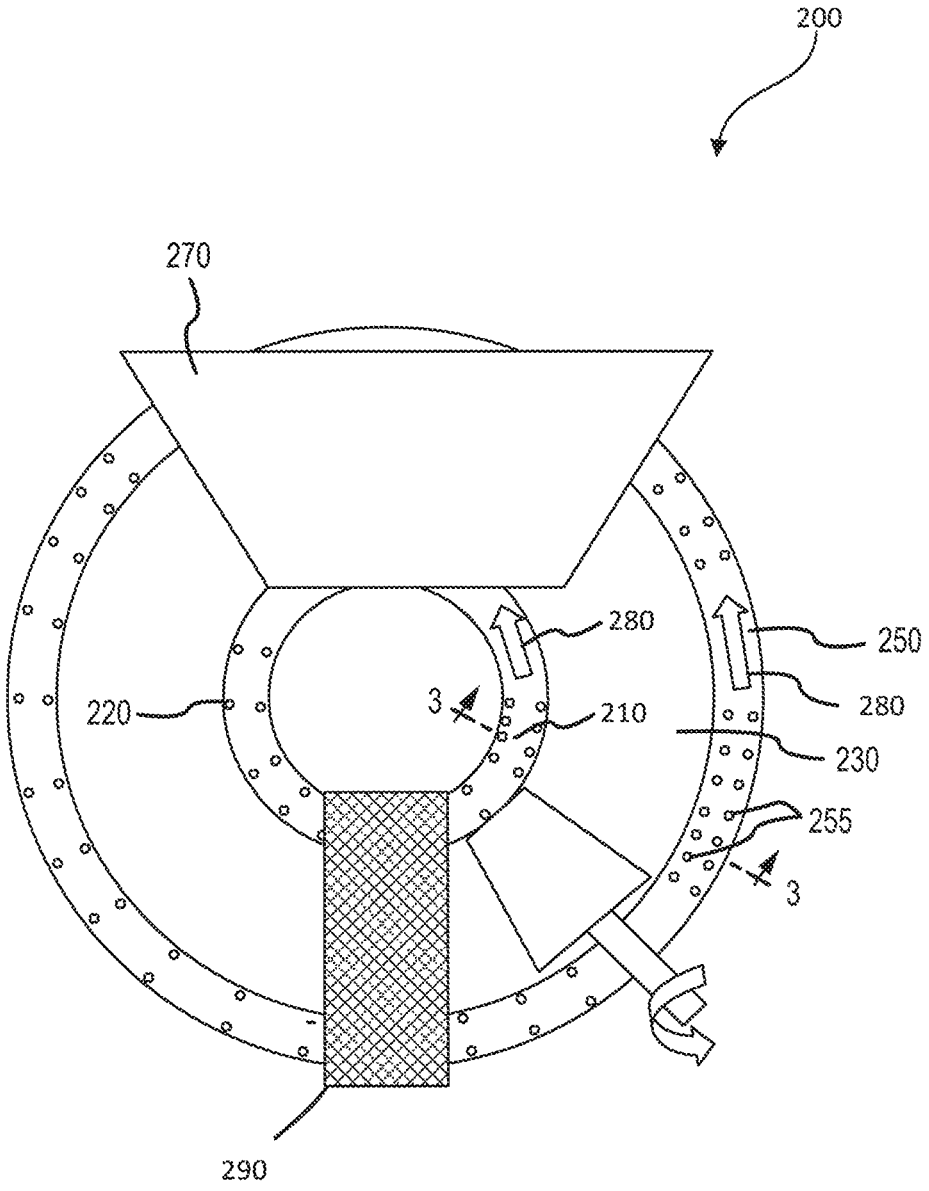
FIG. 2 illustrates a top view of a circular needle loom configured to receive the transport layer securing mechanism according to various embodiments related to a stationary bed plate.

According to various embodiments, stationary and/or movable bed plates in a circular needle-punching loom (referred to herein as a "circular needle loom") may be utilized to produce net shape preforms, such as net shape carbon preforms for brakes. Such circular needle looms may be advantageously utilized to form a near net shape needle preform with minimum waste. Stationary bed plates may be smooth bed plates, such that the material to be needled rotates over, and with respect to, the stationary bed plate to facilitate layering and/or needling the textile. With reference to FIG. 2, the material to be needled may rotate in the direction of arrows 280. Movable bed plates may be rotatable bed plates that comprise a surface which generates friction between the bed plate and the material to be needled such that the bed plates move and/or entrain the material to facilitate layering and/or needling the textile. The circular needle loom may comprise a needling zone.

According to various embodiments and with reference to FIG. 1, a transport layer 100 configured to carry an initial preform layer for building and/or needling on a circular needle loom (CNL) 200 (with brief reference to FIGS. 2) is depicted. The methods and systems described herein apply to both smooth and brush bed-plate CNLs. Similarly, the methods and systems described herein apply to both rotating and stationary bed plate CNLs. The transport layer 100 may comprise a carbonized carbon fiber layer 160 on which subsequent carbonized carbon fibers layers may be secured through needling to build a preform. The transport layer 100 may comprise a robust low cost substrate, such as cotton, rayon, polyester or other low cost natural and/or synthetic yarns. This substrate may be referred to herein as a scrim layer 110. The carbonized carbon fiber layer 160 may be coupled to the scrim layer 110. The transport layer 100 may be fabricated in the shape of annulus. The transport layer 100 may be any desired thickness. Between inner circumference (ID) 105 and outer circumference (OD) 190 of transport layer 100 may be at least one carbonized carbon fiber layer 160 secured onto the robust low cost substrate (e.g., scrim layer 110). A width W of scrim layer 110 proximate the OD 190 and/or a width W' of the transport layer 100 proximate the ID 105 of transport layer 100 may be configured for securing the transport layer 100 to the corresponding moving parts of the CNL 200. For instance, in the case of a brush bed plate for a circular needle loom a pair of concentric rings, such as metallic rings 115, 125 may be configured to secure the transport layer 100 to the brush bed plate. This transport layer 100, in response to being secured, at least temporarily, to the CNL 200 may be a transport mechanism for the carbonized carbon fiber layer 160 utilized to build a complete preform and/or additional layers of the preform. Additional carbon fiber layers may be laid-down on this carbonized carbon fiber layer 160 and subsequently needled. In response to the targeted/predetermined number of layers being needled, the mechanisms securing the edges of the first layer may be released and the preform may be easily removed manually and/or mechanically from the CNL 200. There may be a small amount of cohesion between the transport layer 100 and the brush bed-plate.

Figure 3:
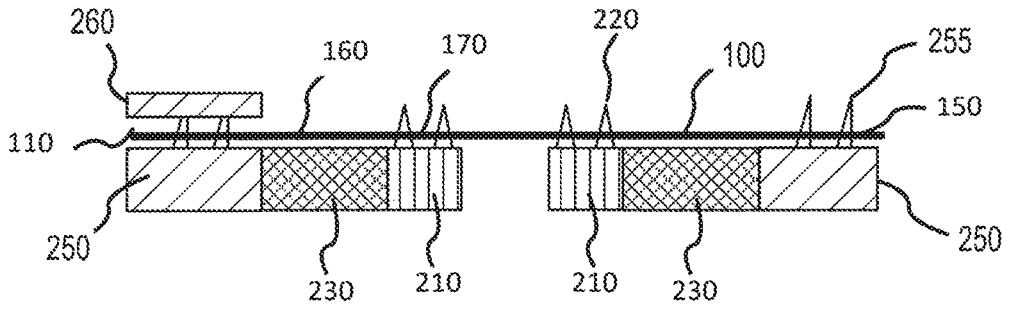
FIG. 3 illustrates a side view of a circular needle loom configured to receive the transport layer securing mechanism according to various embodiments.

According to various embodiments, and with reference to FIGS. 2 and 3, transport layer 100 may be secured over a smooth bed plate of a circular needle loom, such as through needles, clamps, wheels and/or the like described in greater detail below. In the case of the smooth bed plate there may be little to no interference for removal as the smooth bed plate may comprise an unchannelled surface. The transport layer 100 may be configured to facilitate deploying carbon fibers on a CNL 200.

The transport layer 100 may be fabricated in different manners and secured in various ways. Securing of the transport layer 100 may be accomplished by clamping scrim portions 170, 150 of the scrim layer 110 proximate the ID 105 and OD 190 of the transport layer 100 (width W and/or width W' of scrim portions 150, 170) using support elements 210, 250 such as pins 220, 255 and/or clamps 260 which are configured for rotational movement along the stationary bed plate 230.

Constituent materials and manufacturing of the transport layer 100 may be at least one of a carbonized carbon fiber layer 160 secured onto the robust low cost substrate fabricated with flexible low modulus fibers and use of scrim layer 110 of low modulus fibers. Direct needling of carbonized carbon fiber onto, for example a scrim layer comprised of cotton, has been shown to provide every limited adherence between the carbonized carbon fiber layer 160 and the substrate. Needling of a carbon fiber layer onto a sub-layer of carbon fiber on the other hand provides a much better layer to layer adherence. Once the same carbonized carbon fiber layer 160 is coupled to the scrim layer 110, for example utilizing a sewing step, full needled preforms may be fabricated without delamination of the first carbon layer with the supporting substrate. For instance, annular shaped forms may be formed from a commercial fabric presenting suitable tensile strength and conformity to fabricate the bottom layer of the transport layer.

According to various embodiments and with renewed reference to FIGS. 1 and 2, transport layer 100 may be disposed on stationary bed plate 230, with a first annular shaped scrim portion 170 located proximate support element 210 of the bed plate 230 and a second annular shaped scrim portion 150 located proximate support element 250 of the bed plate 230. First annular shaped scrim portion 170 may be a substantially annular shaped scrim portion substantially surrounded by the substantially annular shaped carbonized carbon fiber layer 160. Second annular shaped scrim portion 150 may be annular shaped scrim portion substantially surrounding the substantially annular shaped carbonized carbon fiber layer 160. The substantially annular shaped carbonized carbon fiber layer 160 may be a single annular shaped carbonized carbon fiber section or made from the aggregate of smaller carbonized carbon fiber sections.

Figure 4:
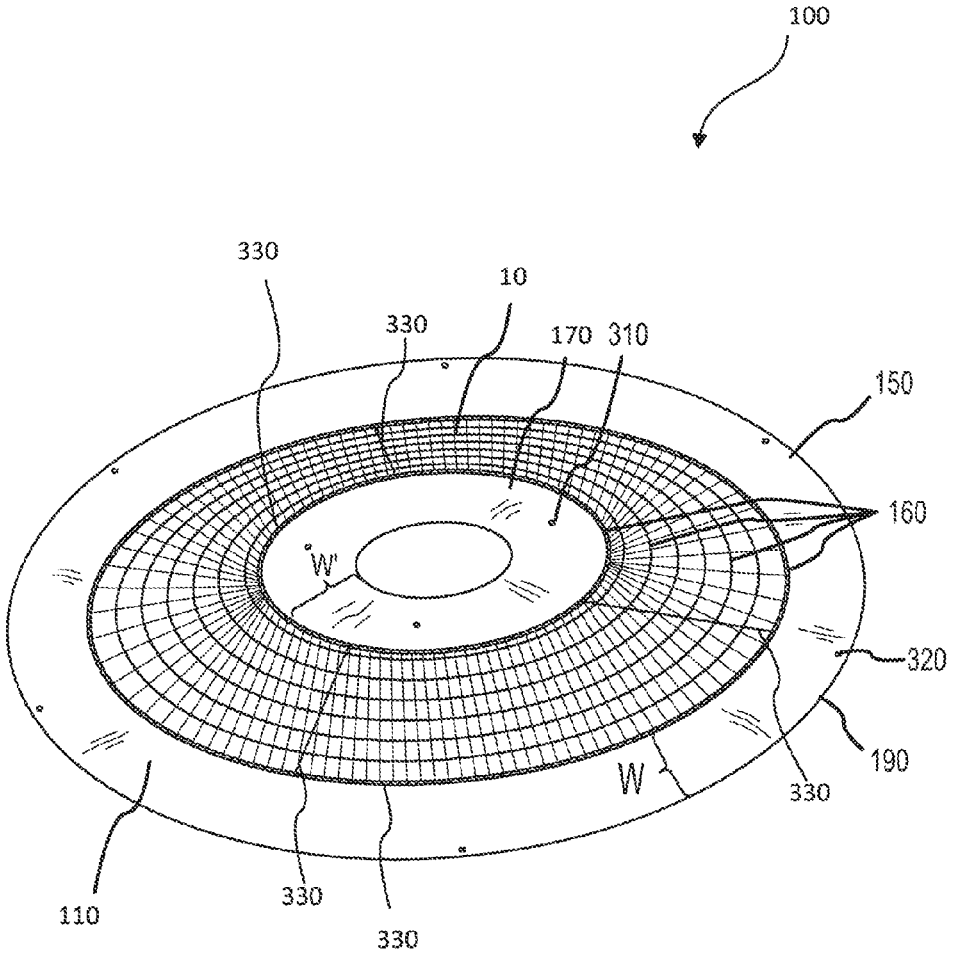
FIG. 4 illustrates a transport layer according to various embodiments.

According to various embodiments, cotton may be used as scrim layer 110 at least because it burns cleanly and/or combusts completely during subsequent processing of the preform. As desired, other fibers and/or combinations of various materials may be used for the fabric substrate. Carbonized carbon fiber layer 160 may be secured onto the scrim layer 110 substrate by sewing the carbonized carbon fiber layer 160 to the scrim layer 110, such as along the ID 105 and OD 190 of the carbonized carbon fiber layer 160 as shown by stitch lines 330 in FIG. 4. Stitch lines 330 may take any desired path. Guide holes 310, 320 located within width W and/or width W' of scrim portions 150, 170 may facilitate placement of the transport layer 100 on the CNL 200. According to various embodiments, radial stitch lines 330 may be added. An inner and outer band of scrim portion (e.g., scrim portions 150, 170) may be left bare or without an attached carbon fiber layer 160 to provide a sturdy flexible attachment surface to the suitable moving parts of the CNL 200. Alternatively, the carbonized carbon fiber layer 160 may be built by placing and sewing cut carbon fabric sectors onto one or more sections of scrim layer 110.

According to various embodiments, a carbon fabric may be formed in an annular shape in lieu of additional cotton substrate.

Needling of flexible low modulus fibers, such as PAN OPF, rayon or phenolic fibers, into the cotton scrim layer 110 substrate may provide a larger z fiber bundles for anchorage into the scrim layer 110. This feature may be beneficial for securing the first carbonized carbon fiber layer 160 onto the scrim layer 110 trough needling instead of sewing. Preforms may be successfully constructed by first securing a substantially annular shaped scrim layer 110 onto a brush bed plate, then adding on the CNL 200 a first layer of carbonized carbon fiber and a layer of PAN OPF web and needling the carbonized carbon fiber layer 160 and layer of PAN OPF web combination. Anchorage of the carbonized carbon fabric onto the scrim layer 110 may be achieved, such as through sewing the carbonized carbon fabric layer 160 to the scrim layer 110. Subsequent layers may be needled using carbonized fiber added on top of the CNL 200, such as on top of the carbonized carbon fiber layer 160 and a layer of PAN OPF web. Alternatively, the carbonized carbon fiber layer 160 may be secured to the substrate through local adhesive application.

Upon completion, the preform and attached scrim portions 150, 170 may be easily removed from the brush bed plate and/or smooth bed plate without encumbrances. The method disclosed herein to transport fibers to and/or from the CNL 200 enables the realization of net shape preforms with alternate fiber architectures. A net shape preform indicates that the initial production of the item is very close to the final (net) shape. For instance, the method disclosed herein is configured to enhance the use of alternate methods to fabricate the complete textile and/or a portion of the complete textile directly on the CNL 200 using, for example fiber placement technologies as described by U.S. patent application Ser. No. 14/231,242, "METHOD TO TRANSPORT AND LAY DOWN DRY FIBER BUNDLES" Filed on Mar. 31, 2014 which is incorporated by reference herein and the use of other forms of carbon fibers such as more difficult to handle stretch broken fibers or cut short fibers as described By U.S. patent application Ser. No. 14/230,246, "METHODS TO FABRICATE NEEDLED PREFORMS WITH RANDOMLY ORIENTED SHORT LENGTH CARBON FIBERS" Filed on Mar. 31, 2014 which is incorporated by reference herein. In addition the set-up time and preform removal time are kept to a minimum as the transfer kit, including the scrim portions 150, 170, is prepared off-line.

Direct fabrication of the complete textile 10 may be accomplished on the CNL 200 using a positive tow transport/tow manipulation/tow placement approach, fabrication of a shaped fabric more loosely held with opened tows, and/or fabrication of preforms with short fiber lengths. The method disclosed herein to transport fibers also enables the use of a brush bed plate configuration as a candidate for industrial production of net shape preforms. In this way, a preform is more easily removed from CNL 200, so there tends to be less downtime as compared with conventional systems that do not utilize a transport layer 100.

Any structure that may facilitate moving and/or securing the transport layer 100 and/or the complete textile 10 is contemplated within the scope of the present disclosure. It should be understood that in various embodiments, the positional structure (e.g., the inner and outer band of scrim portions 170, 150 left bare or without an attached carbon fiber layer 160) may only be located at the ID 105 or OD 190 of the textile 10, or at both the ID 105 and the OD 190.

Various embodiments include mechanisms and/or apparatuses that utilize the transport layer 100 to secure and/or move the textile 10 with respect to a stationary bed plate 230 of a CNL 200, in order to increase the efficiency of manufacturing a needled preform. For example, with reference to FIGS. 2 and 3, a stationary bed plate 230 such as smooth circular bed plate, is disposed between rotational outside support element 250 and rotational inside support element 210. Support elements 210, 250 may include pins and/or spikes 220, 255 that protrude through transport layer outside edge and/or may include retractable clamps 260 to facilitate rotating transport layer 100 with rotating support elements 210, 250, such as respectively including pins 220, 255. Stated another way, pins and/or spikes 220, 255 act as a motive retention element rather than as an element utilized to lay down tows of fiber. Such a configuration facilitates rotating transport layer 100 around stationary bed plate 230 with rotating support elements 210, 250 (e.g., respectively including pins 220, 255). In an embodiment, support elements 210, 250, (e.g., respectively including pins 220, 255) may comprise a plurality of individual support elements disposed proximate the ID 105 and OD 190 of the circumferential transport layer 100. Rails, chains, belts and other transport/entrainment mechanisms may be utilized to rotate support elements 210, 250 and/or other types of engagement members (e.g., respectively including pins 220, 255) disclosed herein.

Rotating support elements 210, 250 (e.g., respectively including pins 220, 255) may be configured to rotate with respect to stationary bed plate 230 until a desired number of layers of textile 10 are needled with needling boards, such as within needling zone 270. To accommodate increased thickness of the preform as the number of layers increases, the top surface of pins 220, 255 may be recessed.

In various embodiments, retractable clamps 260 have a plurality of degrees of movement, such as a vertical motion to pinch and release textile 10, and/or a rotational motion to clear the path for removal of the preform following completion of the needling operation with the desired number of textile layers. In various embodiments, retractable clamps 260 may be activated using pneumatic, hydraulic or electrical systems. Further, in an embodiment, retractable clamps 260 may utilize a swivel motion to retract, such that retractable clamps 260 may have a c-shaped geometry and may be articulated around a horizontal axis. The c-shaped clamps 260 swivel toward and away from the textile around that axis to facilitate clamping and releasing the textile.

In an embodiment, clamps 260 and/or pins 220, 255 may be utilized to secure the first few bottom layers of the preform. Further, clamps 260 and/or pins 220, 255 may be utilized to secure the transport layer 100. Additional sets of clamps may be controlled in pairs (e.g., one pair constitutes one inner and one outer clamp) and/or at different times to provide clamping along the edges of textile 10. For example, a first pair of clamps may be utilized to secure the first layer of textile 10 to support elements 210, 250 (e.g., respectively including pins 220, 255) as the transport layer 100 is disposed on the stationary bed plate 230.

In various embodiments, mechanisms may be utilized to press the transport layer 100 over pins 255, 220 and/or to otherwise secure transport layer 100 to rotational outside support element 255 and rotational inside support element 210 (e.g., respectively including pins 220, 255). For example, engagement members such as pressing bars, fingers, and/or combs may be positioned along sections of the inside and/or outside support elements to push the first annular shaped scrim portion 170 and/or the second annular shaped scrim portion 150 of the transport layer 100 onto pins 220, 255.

In various embodiments, mechanisms may be utilized to press the transport layer 100 over pins 255, 220 and/or to otherwise secure transport layer 100 to rotational outside support element and rotational inside support element (e.g., pins 220, 255). For example, engagement members such as pressing bars, fingers, and/or combs may be positioned along sections of the inside and/or outside support elements to push the first annular shaped scrim portion 170 and/or the second annular shaped scrim portion 150 of the transport layer 100 onto pins 220, 255.

It should be understood that, although a first annular shaped scrim portion 170 and a second annular shaped scrim portion 150 have been disclosed to facilitate securing a transport layer 100 to a bed plate, any structure may be utilized to secure or rotate the textile without departing from the scope of the present disclosure. For example, any positional structure that may be utilized to increase the efficiency and reduce the cost of manufacturing a needled preform is contemplated within the scope of the disclosure. Further, in various embodiments, one type of structure may be utilized on the OD of the textile and/or transport layer 100, and the same or different structure may be utilized on the ID of the textile. Additionally, wheels, clamps, and/or combinations of the same may be utilized to facilitate securing and/or rotating the textile.

Existing reels, spools and other mechanisms may be used for storing and deploying textiles, fiber bundles and/or carbon fiber tows, such as to CNL 200. A fiber delivery system 290 may be configured to lay down tows of fiber on the transport layer 100 (See FIG. 2). This carbon fiber delivery system 290 may be any suitable guide. Although this disclosure illustrates and describes various embodiments, equivalents and modifications will occur to others who are skilled in the art upon reading and understanding of the disclosure.

Figure 5:
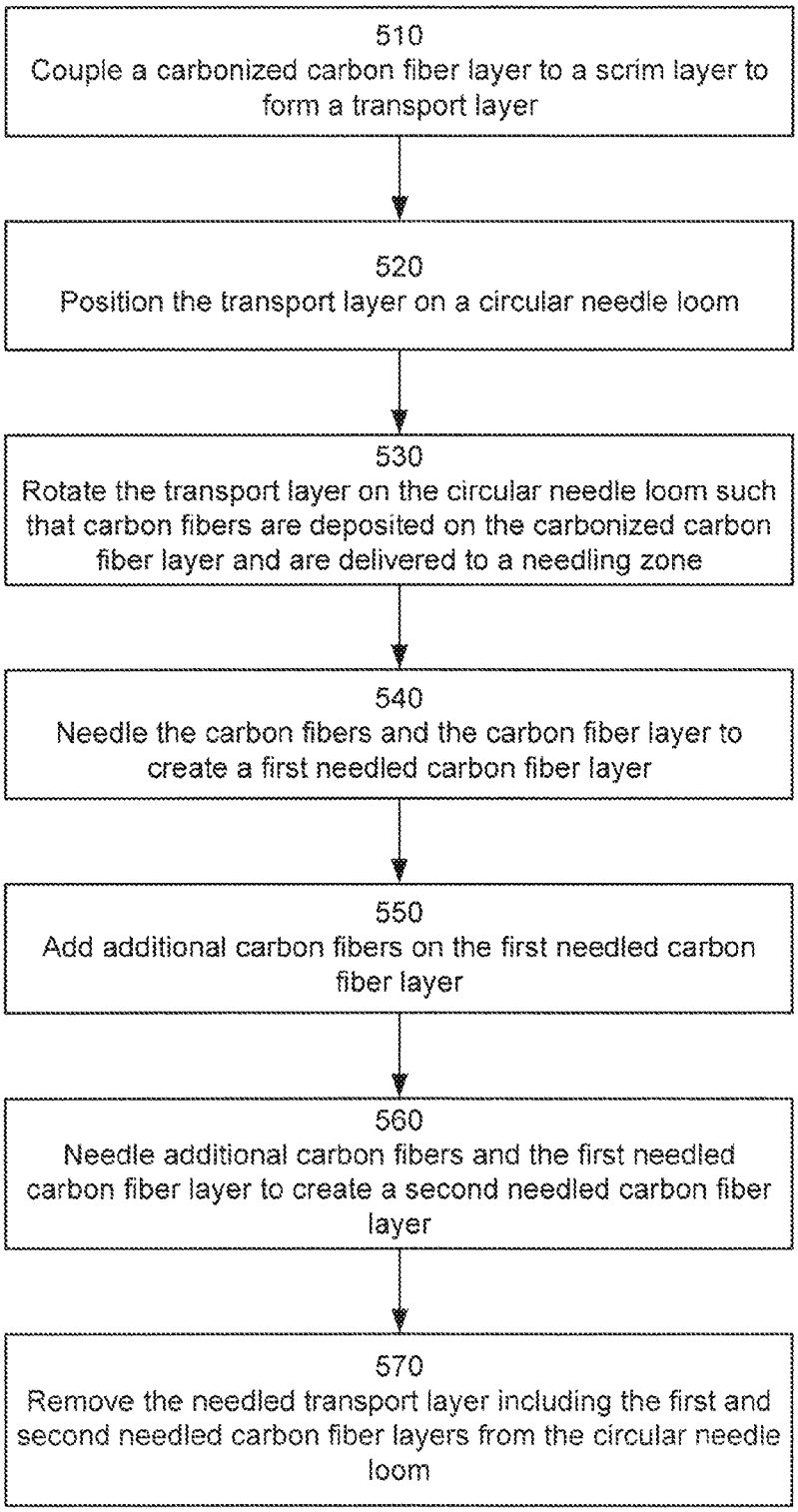
FIG. 5 depicts a process flow of utilization of a transport layer according to various embodiments.

In various embodiments and with reference to FIG. 5, a process for utilizing the transport layer 100 may include coupling a carbonized carbon fiber layer 160 to a scrim layer 110 to form a transport layer 100 (Step 510). The process may include positioning the transport layer 100 on a circular needle loom 200 (Step 520). The process may include rotating the transport layer 100 on the circular needle loom 200 such that carbon fibers are deposited on the carbonized carbon fiber layer 160 and are delivered to a needling zone 270 (Step 530). The process may include needling the carbon fibers and the carbon fiber layer 160 to create a first needled carbon fiber layer (Step 540). The process may further include adding additional carbon fibers on the first needled carbon fiber layer (Step 550). The additional carbon fibers and the first needled carbon fiber layer may be needled to create a second needled carbon fiber layer (Step 560). The process may include removing the transport layer 100 including the first needled carbon fiber layer and the second needled carbon fiber layer (e.g., the textile 10) from the circular needle loom 200 (Step 570).

Additionally, benefits, other advantages, and solutions to problems have been described herein with regard to various embodiments. However, the benefits, advantages, solutions to problems, and any elements that may cause any benefit, advantage, or solution to occur or become more pronounced are not to be construed as critical, required, or essential features or elements of the invention. The scope of the invention is accordingly to be limited by nothing other than the appended claims, in which reference to an element in the singular is not intended to mean "one and only one" unless explicitly so stated, but rather "one or more." Moreover, where a phrase similar to "at least one of A, B, and C" or "at least one of A, B, or C" is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

As used herein, the singular forms "a," "an," and "the" include plural referents unless the context clearly dictates otherwise. As used herein, the terms "for example," "for instance," "such as," or "including" are meant to introduce examples that further clarify more general subject matter. Unless otherwise specified, these examples are embodiments of the present disclosure, and are not meant to be limiting in any fashion.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A method comprising:

coupling a carbonized carbon fiber layer to a scrim layer to form a transport layer;

positioning the transport layer on a circular needle loom;

rotating the transport layer on the circular needle loom such that carbon fibers are deposited on the carbonized carbon fiber layer and are delivered to a needling zone;

needling the carbon fibers and the carbon fiber layer to create a first needled carbon fiber layer;

adding additional carbon fibers on the first needled carbon fiber layer;

needling additional carbon fibers and the first needled carbon fiber layer to create a second needled carbon fiber layer; and removing the transport layer comprising the first needled carbon fiber layer and the second needled carbon fiber layer from the circular needle loom.

2. The method of claim 1, wherein the carbonized carbon fiber layer is an substantially annular shaped carbonized carbon fiber layer, wherein the scrim layer is a substantially annular shaped scrim layer, and wherein the substantially annular shaped carbonized carbon fiber layer substantially surrounds a first annular shaped scrim portion, and wherein a second annular shaped scrim portion substantially surrounds the substantially annular shaped carbonized carbon fiber layer.

3. The method of claim 2, wherein the substantially annular shaped scrim layer comprises at least one of cotton, rayon, polyester or other low cost natural or synthetic yarns.

4. The method of claim 2, wherein the substantially annular shaped carbonized carbon fiber layer is at least one of sewn, needled, or bonded onto the substantially annular shaped scrim layer.

* * * * *